US006290788B1

(12) United States Patent
Claus et al.

(10) Patent No.: US 6,290,788 B1
(45) Date of Patent: Sep. 18, 2001

(54) PROCESS FOR MANUFACTURE OF PRECISION INTERSTITIAL-FREE STEEL TUBES

(75) Inventors: Ronald Claus, Welver; Jürgen Wiete, Melle; Rüdiger Hahn, Soest; Stefan Meimeth, Hamm, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/214,691

(22) PCT Filed: Jul. 4, 1997

(86) PCT No.: PCT/DE97/01452

§ 371 Date: Feb. 8, 1999

§ 102(e) Date: Feb. 8, 1999

(87) PCT Pub. No.: WO98/01242

PCT Pub. Date: Jan. 15, 1998

(30) Foreign Application Priority Data

Jul. 8, 1996 (DE) ..... 196 28 714

(51) Int. Cl.[7] ..... C21D 8/10

(52) U.S. Cl. ..... 148/593; 148/650; 148/651

(58) Field of Search ..... 148/593, 650, 148/651

(56) References Cited

FOREIGN PATENT DOCUMENTS

004319431C1 * 11/1994 (DE) ..... 148/593
401108346A * 4/1989 (JP) .

* cited by examiner

*Primary Examiner*—Deborah Yee
(74) *Attorney, Agent, or Firm*—Cohen, Pontani, Lieberman & Pavane

(57) ABSTRACT

A process for producing precision steel tubes includes cold forming tube blanks, in particular in a plurality of forming steps, with or without an internal tool. In this process, a tube blank made from interstitial free IF steel is used as the starting material.

6 Claims, No Drawings

PROCESS FOR MANUFACTURE OF PRECISION INTERSTITIAL-FREE STEEL TUBES

This application is a 371 of PCT/DE97/01452 filed Jul. 4, 1997.

BACKGROUND OF THE INVENTION

1. Field of the Invention

The invention relates to a process for producing precision steel tubes by cold forming of tube blanks, in particular in a plurality of forming steps, with or without an internal tool.

2. Description of the Prior Art

A process for producing precision steel tubes by call forming of tube banks is known from DE 38 14 648 A1.

For many years, it has been known in the general prior art to reduce the dimensions (diameter and wall thickness) of seamless or welded steel tubes further by cold forming, to produce precision tubes. In doing so, it is possible to work with or without an internal tool. The most widespread method is cold forming by cold drawing. However, it is also possible, for example, for the tube blanks used as starting material to be formed to the desired dimensions by cold pilger rolling. The latter method is usually limited to the working of stainless steels and special alloys. Tube blanks made from structural steels are predominantly used in particular during cold drawing.

Changes in the technological properties often occur during the cold forming of steels. Depending on the degree of deformation, there are significant increases in the tensile strength (cold work hardening). For structural steels, the increase in tensil strength is inevitable because of the carbon content and nitrogen content of the steel (significantly over 0.005%), considerable deterioration in the ductility (e.g. elongation at break) accompanies the increase in tensile strength. The cold work hardening, which is often highly desirable in the end product, represents a considerable drawback for the cold forming itself, since as the extent of cold forming increases ever greater forces have to be applied for further forming, so that the performance limits of the forming machine employed may be exceeded. Furthermore, the decreasing ductility imposes limits on the further cold formability. For these reasons, it is normally necessary to carry out a microstructural transformation by a normalizing treatment after one or two cold forming steps. Before the next cold forming step can take place, it is necessary to form a drawing compound layer and a drawing compound carrier layer. This considerably increases the outlay involved in producing precision steel tubes.

U.S. Pat. No. 5,200,005 has disclosed a process which allows the production of sheets of increased strength and ductility by hot forming from a so-called IF (Interstitial steel). If steels have been known for many years for the production of deep drawing sheets. In a first variant, U.S. Pat. No. 5,200,005 provides for the production of steel strip by roughing rolling at a temperature of 1260° C. and finishing rolling at approximately 710° C. According to a second process variant, the roughing rolling takes place at 850° C. and the finishing rolling takes place at approximately 700° C.

Hitherto, there has been no disclosure of steel tubes being produced from IF steels. On the one hand, this may well result from the fact that IF steels inherently have a comparatively low strength. On the other hand, such steels cannot be worked by hot rolling under the standard process conditions for producing seamless steel tubes, since their deformation resistance is too low. The production of welded tubes from IF steel has not been considered either hitherto.

SUMMARY OF THE INVENTION

The object of the invention is to propose a process which enables the production of precision steel tubes which have an extraordinarily high ductility (e.g. elongation at break) in relation to their strength.

This object is achieved by a process for producing precision steel tubes by cold forming tubes blanks comprising interstitial free (IF) steel as the starting material.

The invention includes using tube blanks made from an IF steel as the starting material for the production of precision steel tubes. IF steels of this nature are distinguished by the very low levels (by weight) of the elements carbon and nitrogen, which embed themselves interstitially in the iron crystal lattice. The tube blanks can be produced without a seam by hot rolling under special conditions or by welding. If the tube blanks are welded, to use customary HF (high frequency) welding processes or, advantageously, laser welding processes (which have a very small heat-affected zone) may be used. The microstructure of the tube blanks used should have a grain size of at least the quality ASTM6 up to ASTM9.

The composition of the IF steel used in the process according to the invention advantageously comprises the following elements and quantities as follows:

| | Element | Advantageous composition | Preferred composition |
|---|---|---|---|
| | C | <0.005% | <0.003% |
| | Si | <0.2% | approx. 0.02% |
| | Mn | 0.05–0.4% | 0.05–0.15% |
| | P | <0.04% | <0.01% |
| | S | <0.01% | <0.005% |
| | $Al_{tot}$ | 0.02–0.05% | approx. 0.02% |
| | Cu | <0.1% | <0.1% |
| | Cr | <0.2% | <0.1% |
| | Ni | <0.2% | <0.1% |
| | Mo | <0.1% | <0.01% |
| at least one of the two elements | (Ti | 0.01–0.12% | together |
| | (Nb | 0.01–0.24% | approx. 0.06% |
| | B | <0.0005% | <0.0003% |
| | N | 0.0020–0.0120% | approx. 0.0050% |
| | Remainder iron and usual impurities. | | |

The tube blanks made from IF steel are eminently suitable for being processed further by cold forming to give precision steel tubes. Hitherto, such precision tubes were customarily produced from seamless or welded blanks of conventional structural steels by cold drawing, Because of the limited cold formability of the conventional structural steel, the cold drawing had to be carried out in a very large number of part-steps (individual draws), if the intention was to produce tubes of particularly small diameter, as is the case, for example, with precision steel tubes which are to be used as fuel-injection pipes or as starting material for the production of rivets. When fuel-injection pipes are made from conventional structural steel, a normalizing treatment is usually carried out after each cold draw. Because of the large number of working steps required, this known process sequence involves a high level of outlay. In addition, in the materials class of structural steels, each deformation-induced increase in strength is associated with a reduction in ductility. However, in many applications of precision tubes, it would be desirable to simultaneously have good strength and ductility values. In this respect, tubes made from IF steel offer the advantage that despite considerable increases in strength due to cold deformation, only comparatively low losses of ductility have to be accepted.

In addition when the seamless or welded tube blanks made from IF steel which are used according to the invention, the production outlay is reduced very significantly during cold forming. This cold forming may, for example, be carried out by cold drawing with or without an internal tool. Although each individual draw does decrease the ductility, the amount of decrease is considerably less than for a carbon steel and for all other steels which are conventionally used in the production of precision tubes. For this reason, steel tubes made from IF steels can be reduced to a specific dimension with a considerably lower number of individual draws compared to the number required for a carbon steel. The degree of deformation at each individual draw may therefore be greater. Consequently, the invention is also advantageous if the cold forming takes place in only a single forming step. A further important fact is that on average considerably more individual draws can be preformed in succession without requiring a reduction in the deformation resistance by an annealing treatment to carry out further cold forming to even smaller dimensions. Advantageously, the ratio of the number of deformation steps to the number of annealing treatments is at least 3, preferably at least 3.5, and particularly preferably at least 4. Preferably, the annealing should in each case take place at below the normalizing temperature, within a temperature range of approximately 680 to 720° C. If the increase in strength is to be largely maintained after the cold work hardening and, at the same time, a very high ductility is desired, the stress-relief annealing may be preformed at temperatures below 550° C. In order to achieve a particularly high strength of the precision tube produced after cold forming, it is advantageously possible for the final annealing treatment to be followed by a further cold forming operation in at least 3 deformation steps. This makes it easy to achieve strength levels which are comparable to those of customary structural steels (St37), these favorable strength properties being accompanied by excellent ductility values. To this extent, the precision tubes produced using the process according to the invention are even superior to the known precision tubes made from carbon steel. Overall, production according to the invention involves considerably less outlay, even though the production of the steel starting material involves a higher level of outlay, since the carbon and nitrogen contents have to be reduced to very low values. If a final annealing operation is carried out at 680–720° C. after the cold forming, the process according to the invention provides tubes or tubelike hollow bodies which, given their low strength, have an extraordinary level of deformability.

DETAILED DESCRIPTION OF THE PREFERRED EMBODIMENT

The invention is explained in more detail below with reference to two exemplary embodiments.

EXAMPLE 1

On a cold-drawing bench, a seamless tube blank made from an IF steel was used, with the following composition:

| | |
|---|---|
| C | 0.003% |
| Si | 0.01% |
| Mn | 0.11% |
| P | 0.007% |
| S | 0.005% |
| $Al_{tot}$ | 0.024% |
| Cu | 0.05% |
| Cr | 0.04% |
| Ni | 0.03% |
| Mo | 0.01% |
| V | <0.002% |
| Ti | 0.064% |
| Nb | 0.0020% |
| B | <0.0003% |
| N | 0.0046% |
| Fe | Remainder. |

This tube blank had a diameter of 42.4 mm and a wall thickness of 5.6 mm, with an average grain size of the quality ASTM6. The cold drawing to final dimensions of 6.0 mm diameter and 2.0 mm wall thickness was carried out in a total of six individual draws. An annealing treatment at 680–720° C. followed the third cold draw. If a comparable tube had been produced from an St37 steel, cold forming in six cold draws would also have been possible, but it would have been necessary to carry out at least three intermediate annealing treatments in order to reduce the deformation resistance of the material to a value which is acceptable for the drawing bench employed.

EXAMPLE 2

An HF-welded tube blank of the same dimensions and the same composition as in Example 1 was placed on a cold-drawing bench. The average grain size of this tube blank corresponded to the quality ASTM7. The cold forming was carried out in a total of 11 cold draws, and the tube being formed was annealed at 720° C., below the normalizing temperature, after the 3rd, 6th and 8th draws. The cold deformation resulted in precision tubes with a diameter of only 2.5 mm and a wall thickness of only 0.25 mm. Producing this type of precision tube, in the conventional way from an St37 requires a total of 13 cold draws and 5 annealing treatments.

The fact that, according to the invention, tube blanks made of IF steel are used enables a reduction in the outlay required to produce precision steel tubes to be reduced, even though the starting material itself requires considerably higher outlay (production of the molten steel). The controlled utilization of cold work hardening by means of one or more forming steps is advantageously possible without impairing the ductility to an undesirably great extent. It is therefore possible to achieve technological properties which are equivalent or even superior to those of simple structural steels (such as for example St37). This can be achieved with comparatively few cold forming steps, so that the capacity of an existing cold-drawing bench can be increased accordingly. Moreover, the number of annealing treatments which are required between individual cold drawing steps can be reduced significantly. It is possible to produce tubes which have an extraordinarily high formability.

What is claimed is:

1. A process for producing steel tubes by cold forming tube blanks, comprising the steps of:

performing at least one cold forming step on a tube blank comprising an interstitial free (IF) steel.

2. The process of claim 1, wherein said step of performing comprises performing at least one cold forming step on a tube blank comprising an IF steel having the following composition.

| | | |
|---|---|---|
| | C | <0.005% |
| | Si | <0.2% |
| | Mn | 0.05–0.4% |
| | P | <0.04% |
| | S | <0.01% |
| | $Al_{tot}$ | 0.02–0.05% |
| | Cu | <0.1% |
| | Cr | <0.2% |
| | Ni | <0.2% |
| | Mo | <0.1% |
| at least one of | (Ti | 0.01–0.12% |
| | and (Nb | 0.01–0.24% |
| | B | <0.0005% |
| | N | 0.0020–0.0120% |
| | Remainder iron and usual impurities. | |

3. The process of claim 1, wherein said step of performing comprises performing at least one cold forming step on a tube blank comprising an IF steel having the following composition.

| | | |
|---|---|---|
| | C | <0.003% |
| | Si | approx. 0.02% |
| | Mn | 0.05–0.15% |
| | P | <0.01% |
| | S | <0.005% |
| | $Al_{tot}$ | approx. 0.02% |
| | Cu | <0.1% |
| | Cr | <0.1% |
| | Ni | <0.1% |
| | Mo | <0.01% |
| At least one of | (Ti | together |
| | and (Nb | approx. 0.06% |
| | B | <0.0003% |
| | N | approx. 0.0050% |
| | Remainder iron and usual impurities. | |

4. The process of claim 1, wherein said step of preforming at least one cold forming step comprises performing a plurality of cold forming steps and performing an annealing treatment at a temperature within the range including 680 to 720° C. after each time a number of said plurality of cold forming steps is performed, such that a ratio of a total number of said plural cold forming steps performed to a total number of annealing treatments performed is at least 3.

5. The process of claim 4, wherein said step of performing at least one cold forming step further comprises performing at least one cold forming step after a final annealing treatment.

6. The process of claim 1, wherein said step of performing comprises performing at least one cold forming step on a tube blank comprising a welded IF steel tube.

* * * * *